United States Patent [19]

Henkin et al.

[11] Patent Number: 4,825,854

[45] Date of Patent: May 2, 1989

[54] HYDROTHERAPY MASSAGE METHOD AND APPARATUS

[76] Inventors: Melvyn L. Henkin, 5011 Donna Ave., Tarzana, Calif. 91356; Jordan M. Laby, 3038 Bayshore, Ventura, Calif. 93001

[21] Appl. No.: 213,595

[22] Filed: Jun. 30, 1988

Related U.S. Application Data

[60] Continuation of Ser. No. 60,767, Jun. 10, 1987, abandoned, which is a division of Ser. No. 796,987, Nov. 12, 1985, Pat. No. 4,692,950.

[51] Int. Cl.[4] ..... A61H 9/00

[52] U.S. Cl. ..... 128/66; 4/492; 4/542; 128/38

[58] Field of Search ..... 128/65, 66, 365, 38; 4/492, 542, 544, 567, 568

[56] References Cited

U.S. PATENT DOCUMENTS

| | | | |
|---|---|---|---|
| 2,237,435 | 4/1941 | Ille | 128/66 U X |
| 4,220,145 | 9/1980 | Stamp et al. | 128/66 |
| 4,339,833 | 7/1982 | Mandell | 128/66 X |
| 4,679,258 | 7/1987 | Henkin et al. | 128/66 X |

*Primary Examiner*—Edgar S. Burr
*Assistant Examiner*—Moshe I. Cohen
*Attorney, Agent, or Firm*—Freilich, Hornbaker, Rosen & Fernandez

[57] ABSTRACT

A hydrotherapy method and apparatus for discharging a fluid stream through an opening in the wall of a water tub, while concurrently translating the stream, to impact against and massage the body of a user.

3 Claims, 10 Drawing Sheets

508
16
506
15
564
500
560
502
524
526
498
522
549
514
516
512
548
520
540
546
542
544

HYDROTHERAPY MASSAGE METHOD AND APPARATUS

This is a continuation of co-pending application Ser. No. 060,767 filed June 10, 1987, now abandoned, which as a divisional of application Ser. No. 796,987 filed on Nov. 12, 1985, now U.S. Pat. No. 4,692,950.

BACKGROUND OF THE INVENTION

This invention relates generally to hydrotherapy and more particularly to a method and apparatus useful in spas, hot tubs, bathtubs, and the like for discharging a fluid (e.g. water-air) stream to impact against and massage a user's body. The apparatus includes a nozzle having a discharge orifice mounted for movement to cause the impacting fluid stream to sweep over an area of the user's body.

Hydrotherapy devices for massaging a user's body by moving a discharge nozzle are disclosed in U.S. Pat. Nos. 4,523,340; 4,339,833; 4,220,145; and 3,868,949. Various other hydrotherapy devices for discharging water-air streams are disclosed in the following U.S. Pat. Nos. 4,502,168; 4,262,371; 3,905,358; and 3,297,025.

SUMMARY OF THE INVENTION

The present invention relates to inprovements in hydrotherapy and more particularly to a method and apparatus for discharging a fluid stream, while concurrently translating the stream, to impact against and massage an area of a user's body. An apparatus in accordance with the invention includes a movable nozzle for discharging a fluid stream substantially perpendicular to the travel path of the nozzle. A user can fixedly position his body proximate to the apparatus to enable the discharged stream to impact against and sweep over an area of the user's body.

In a preferred application of the invention the apparatus is mounted in an opening in the perimeter wall (i.e. including floor) of a spa, hot tub, bathtub, etc., generically referred to herein as a water tub. The apparatus includes a housing which can be formed integral with the tub wall but which more typically comprises a separate box like structure adapted to be mounted adjacent to the rear face of the wall and accessible through an opening in the wall. The apparatus includes a nozzle mounted in the housing for movement along an imaginary surface roughly approximating an extension of the tub wall in the area of the wall opening. Conduit means within the housing supply the fluid stream (preferably a water-air mixture) to the nozzle for discharge substantially perpendicular to the tub wall and generally below the surface line of the water in the tub. The conduit means includes swivel means which permits the nozzle means to move relative to fixed water and air supply sources.

In accordance with one aspect of the invention common to certain embodiments, the nozzle is moved along its travel path by a thrust force produced by a fluid stream component discharged substantially parallel to the path.

In accordance with a different aspect of the invention, the nozzle travel path can be of substantially any shape or size, including complex (i.e. nonlinear and noncircular) shapes comprised of serially arranged linear and/or arcuate portions circumscribing relatively large areas to effectively massage correspondingly large areas of the user's body.

The preferred embodiments of the invention are characterized by the use of a guide means defining a complex path along which the nozzle travels. In accordance with a significant feature of the preferred embodiments, the guide means reorients the nozzle as it travels along the path to continually maximize the thrust force produced by the fluid stream thrust component.

In an exemplary embodiment of the invention, the conduit means includes a flexible tube to couple water and air supply sources to the nozzle. The water and air can be mixed at the supply end of the flexible tube or, alternatively, a dual passage tube can be used with mixing occurring adjacent to the nozzle. In either case, either a motor driven blower or a venturi means can be used to introduce air into the water stream.

In a different exemplary embodiment, the conduit means used to couple water and air supply sources to the nozzle comprises one or more rigid arms mounted for rotation about axes extending perpendicular to the arms. The arms define internal passages for carrying water and air, either separately or mixed, from the supply sources to the nozzle.

In still different exemplary embodiments, the water-air conduit means comprises a substantially rigid tube mounted with a swivel joint (e.g. ball in socket) at its supply end. The swivel joint enables the rigid tube to rotate about its axis as the nozzle coupled to the tubes discharge end travels along the path defined by the guide. The rigid tube can be straight but preferably includes one or more curves (e.g. "S" shape) in order to reduce the required depth of the apparatus housing. In accordance with a significant feature of this embodiment, the motion of the rigid tube is restricted to orientations which assure smooth fluid flow and low pressure drops.

In a preferred arrangement, the guide means preferably includes a guide slot defining the nozzel travel path. The path defined by the guide slot is preferably complex in that it is nonlinear and noncircular but rather is formed by substantially linear and arcuate portions arranged in series. The nozzle structure is keyed to the guide slot to optimally orient the nozzle all along the path to produce maximum thrust. More specifically, the nozzle structure preferably includes a slider member which fits in the guide slot so as to be restricted to translational movement therealong. In accordance with a specific feature of one preferred embodiment, the slider translates along the path in a clockwise direction only, thereby tending to continually tighten a threaded coupling associated with the supply end of the conduit.

The magnitude of the thrust force produced by the fluid stream to drive the nozzle along the travel path depends on various factors including the fluid stream volume, velocity, and discharge angle. The volume and velocity depend on the fluid supply source which typically comprises a motor driven pump which recirculates water from the tub. The component of the fluid stream diverted to produce the thrust force reduces the portion of the stream available for massaging. Accordingly, when designing an apparatus in accordance with the invention, it is important to select a fluid supply source and a discharge angle which provide both sufficient thrust and sufficient massaging action. The magnitude of thrust required should be sufficient to start the nozzle moving from any position along the path when the apparatus is first turned on. A thrust of this magnitude may, however move the nozzle too fast for a comfortable massaging action once the nozzle is in motion.

Accordingly, in preferred embodiments of the invention, a speed sensitive drag means is utilized to introduce drag when the nozzle is in motion in order to limit the speed of the nozzle along the travel path. In an exemplary preferred embodiment, the drag means comprises one or more apertured cupped plates extending radially outward from the conduit means. The cupped plates act as sea anchors to limit the travel speed of the nozzle. The inclusion of the drag means allows for the user to vary the fluid stream flow (as by an adjustable valve) to produce a comfortable impact force without significantly varying nozzle travel speed.

In accordance with a still further aspect of the invention, the housing includes an outwardly extending peripheral flange adapted to bear against the front face of the tub wall around the wall opening. A clamping ring is provided for mounting to the housing adjacent the rear face of the tub wall to clamp the tub wall between the housing flange and the clamping ring. A suitable sealant is preferably inserted between the flange and the tub wall front face and between the clamping ring and tub wall rear face.

DETAILED DESCRIPTION

Figure 1:
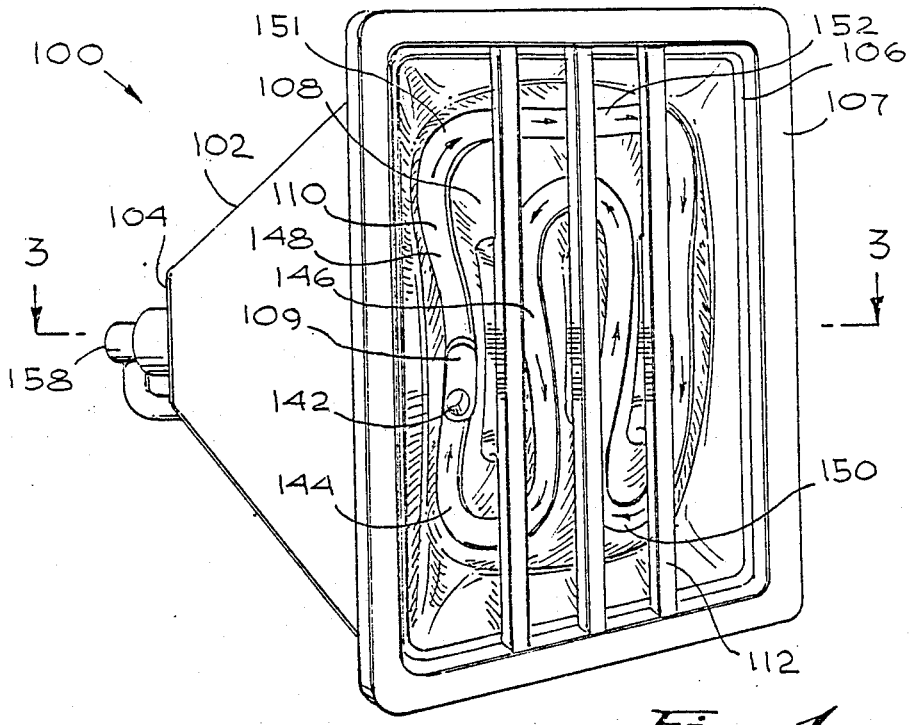
FIG. 1 is an isometric view of a hydrotherapy apparatus in accordance with the present invention.

Attention is initially directed to FIG. 1 which illustrates a hydrotherapy apparatus 100 in accordance with the invention intended to be mounted in the perimeter wall of a water tub such as a spa, hottub, or bathtub for massaging the body of a user. The apparatus 100 is essentially comprised of a box-like housing 102 having a rear wall 104 and an essentially open front wall 106 surrounded by a rectangular frame 107. A guide means 108 is mounted within the frame 107 for guiding a nozzle 109 along a travel path 110 defined by the guide means 108. One or more vertically oriented bars 112 are provided for supporting the back of a user 114, as is generally depicted in FIG. 2.

Figure 2:
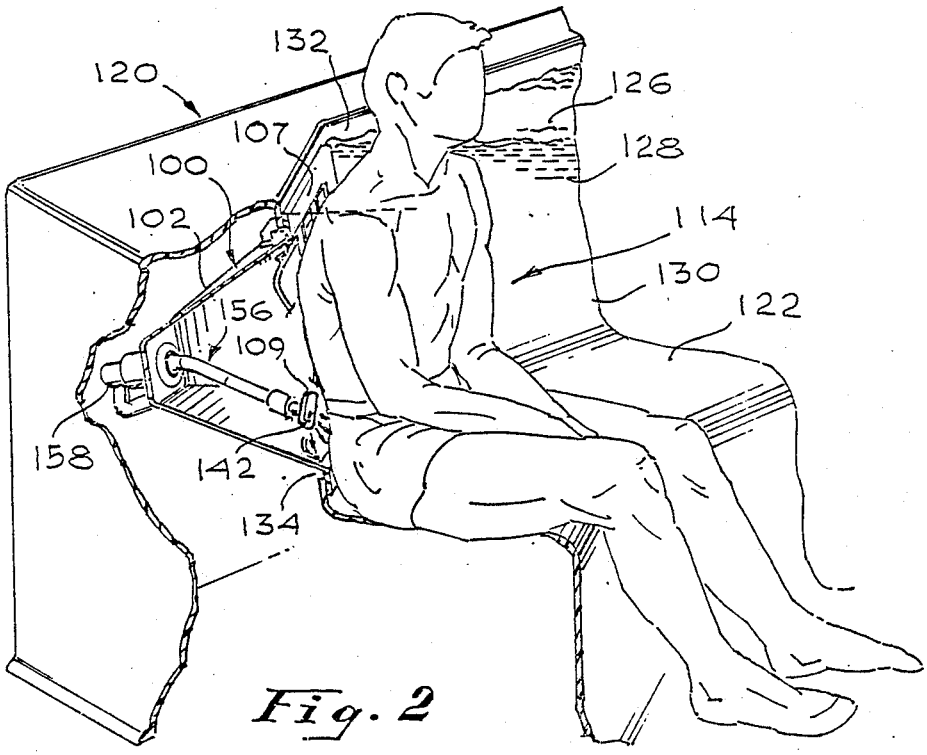
FIG. 2 is an isometric view, partially broken away, depicting the apparatus of FIG. 1 mounted behind the perimeter wall of a water tub, e.g. a spa.

FIG. 2 depicts the hydrotherapy apparatus 100 in use in a typical spa installation wherein the spa tub 120 is shaped to define, for example, a bench 122 upon which the user 114 can comfortably sit with the major portion of his body below the upper surface 126 of a water pool 128. The water tub 120 includes an inner perimeter wall 130 preferably having one or more flat portions 132 through which a wall opening 134 is formed. The apparatus 100 of FIG. 1 is intended to be mounted in the opening 134 with the housing 102 projecting rearwardly from the flat wall portion 132 and with the housing frame 107 bearing against the front face of the flat wall portion 132.

The general function of the hydrotherapy apparatus 100 is to provide a pleasing massaging effect on the body of the user 114 without requiring that the user move his body around a fixedly positioned jet, as is customary in conventional spa installations. In order to achieve this effect, the apparatus 100 includes a nozzle means 109 having an orifice 142 through which a water stream is discharged against the user's body. The nozzle means 109 is operable to travel along a path to cause the discharged water stream to sweep over and impact against a relatively large area of the user's body.

Figure 30:
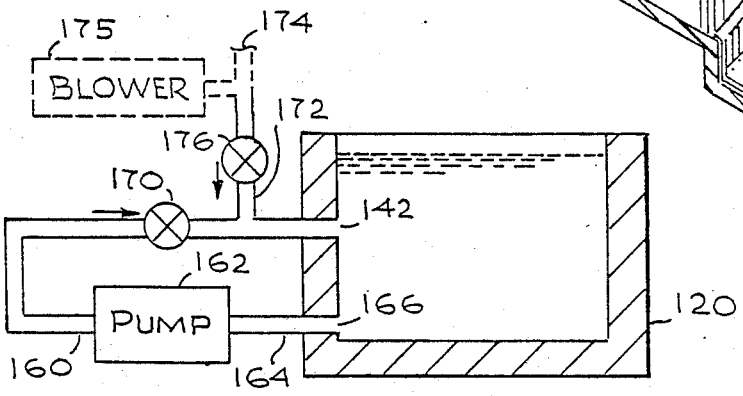
FIG. 30 is a schematic illustration depicting the manner in which an apparatus in accordance with the invention is plumbed in a typical spa installation.

FIG. 1 depicts an exemplary embodiment of the invention in which the nozzle means 109 travels along path orifice 142 back in to the water tub 120. It is preferable, but not necessary, to include a manually adjustable valve 170 in the plumbing line connecting the pump outlet 160 to the conduit means 156. It should be noted that FIG. 30 also schematically depicts an air supply pipe 172 connected to the conduit means 156. The pipe 172 is typically open to the air at 174 permitting the water stream supplied by the pump 162 through conduit means 156, to draw air in through the pipe 172, as by venturi action, for mixing with the water stream. Alternatively, the air can be introduced into the water stream by a motor driven blower 175 coupled to the pipe 172. FIG. 30 also depicts a manually adjustable valve 176 mounted in the air supply pipe 172 to enable the user to control the amount of air introduced into the water stream exiting from the discharge orifice 142.

In the use of the apparatus 100, the nozzle means 109 translates along the path 110 defined by the slot 144 which can circumscribe a relatively large area having, for example, a vertical dimension of approximately twelve inches and a horizontal dimension of approximately eight inches. Thus, the moving nozzle means 109, is able to sweep over a large area of a stationary user's back, continually discharging the impacting water stream it translates along the path 110. As will be seen hereinafter, the nozzle means 109 is driven along the path 110 by a thrust force produced by a discharged water stream.

In the preferred embodiments of the invention, a water stream is discharge from the nozzle means orifice 142 110 defined by a guide slot 144 formed in guide means 108. In accordance with th invention, the guide slot can define a path of substantially any shape, including complex (i.e. nonlinear, noncircular) shapes, as is exemplified in FIG. 1, showing a path 110 comprised of linear and arcuate portions arranged end to end. More specifically, in the exemplary path depicted in FIG. 1, substantially linear path portions 146 and 148 are interconnected by an arcuate portion 150 serially arranged therewith. Similarly, arcuate portion 151 couples the aforementioned linear portion 148 to linear portion 152. The multiple path portions depicted in FIG. 1 are connected in series to form a closed loop along which the nozzle means 109 translates. Although one exemplary path is depicted in FIG. 1, it should be understood that the invention is not restricted to the use of any particular path pattern but rather, an essentially limitless number of path pattern variations are possible.

As will be discussed in great detail hereinafter, the nozzle means 109 is coupled to a conduit means 156, shown in FIG. 2, which supplies a water stream to the nozzle means from a pipe coupled to a water supply fitting 158. Typically, the water supply fitting 158 is supplied with water from the outlet side 160 of a motor driven pump 162, schematically depicted in FIG. 30. The pump 162 has an inlet side 164 coupled to a suction port 166 formed in the wall of a water tub 120. The pump 162 sucks water from the port 166 and supplies a water stream to the conduit means 156, which is then discharged through the nozzle means in a direction substantially perpendicular to the path defined by guide slot 144 but with a component directed parallel the path to thus produce the thrust or reaction force to move the nozzle means 109 along the path. If the nozzle means is restricted to movement along the path, as defined by the guide slot 144, then, of course, it will translate along the path while discharging the water stream in a direction substantially perpendicular to the path to impact against the user's body.

Figures 3, 4:
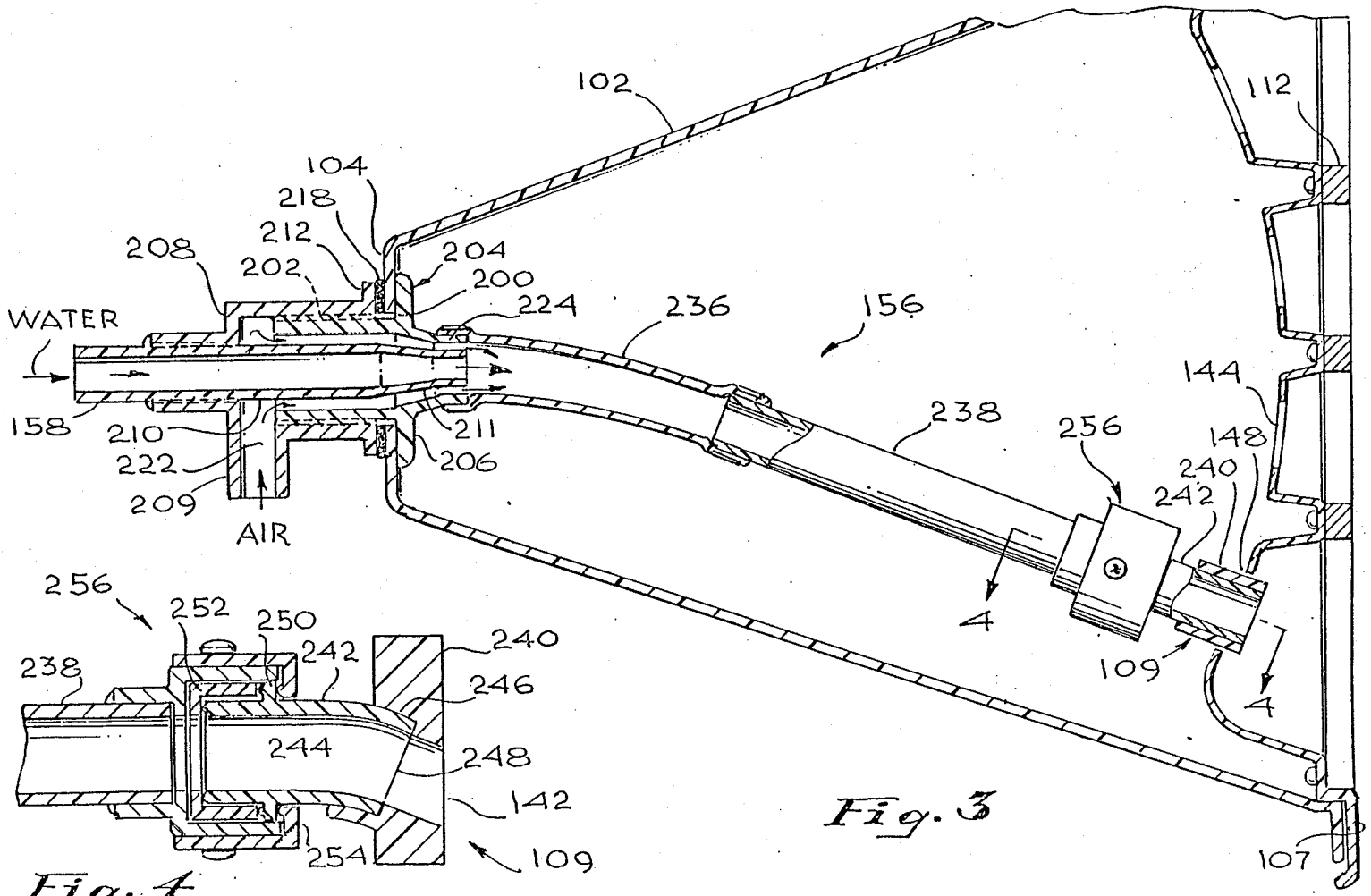
FIG. 3 is a sectional view taken substantially along the plane 3—3 of FIG. 1 depicting a first embodiment of the invention.
FIG. 4 is a sectional view taken substantially along the plane 4—4 of FIG. 3.

Attention is now directed to FIG. 3 which illustrates the internal construction of a first embodiment of the invention. For reference purposes, it is pointed out that FIG. 3 illustrates the aforementioned housing 102, front frame 107, back support bars 112, and guide means 108 defining the guide slot 144 therein. Additionally, FIG. 3 illustrates the water supply fitting 158 and air supply pipe 172.

The embodiment of FIG. 3 depicts the housing 102 as having an opening 200 at its rear wall 104. The threaded cylindrical portion 202 of a fitting 204 extends rearwardly through the opening 200 with the flange 206 of the fitting 204 bearing against the front face of the housing rear wall 104. A fitting 208 is threaded on the portion 202 of fitting 204. Fitting 208 has a nipple 209 intended to be coupled to aforementioned air supply pipe 172. The water supply fitting 158 is threaded into fitting 208 and includes a rigid tube 210 extending through a central bore of fitting 204 and terminating at a tapered discharge end 211. Fitting 208 carries a flange 212 which bears against a sealing gasket 218. The nipple 209 defines an air passage 222 which extends to and is essentially coterminous with the tapered end 211 of the tube 210. As pressurized water flows through tube 210, it exits at the discharge end 211 and produces a reduced pressure, by venturi action, which draws air into the passage 222 from the aforementioned air supply pipe 172. Thus, as the water stream is discharged from the tube end 211, it mixes or entrains air therein from the adjacent end of the air passage 222.

Secured around a forwardly projecting nipple 224 of fitting 204 is one end of a short flexible tube 236. The flexible tube 236 is joined at its other end to a rigid tube 238. The tubes 236 and 238 comprise the aforementioned conduit means which, within the housing 102, couple the water-air stream to the nozzle means 109 mounted for translation along the guide slot 144.

FIG. 4 illustrates the nozzle means 109 as comprising a slide member 240 secured to the end of a nozzle member 242 having an internal passage 244. The nozzle member 242 includes a section 246 for diverting the water-air stream by an angle of approximately 5°–25°. The nozzle member 242 has a discharge orifice 248 which is immediately adjacent the aforementioned discharge orifice 142 in slide member 240. The nozzle member 242 is mounted for rotation relative to the rigid tube 238. More specifically, the nozzle member 242 includes a flange 250 which is mounted between bearing members 252 and 254 of a sealed rotational coupler 256. Rotational couplers of the type depicted in FIG. 4 are well known and will not be discussed herein. It is only important that it be understood that the nozzle member 242 be coupled to the rigid tube 238 in a manner which permits relative rotation therebetween around the axis of tube 238.

FIG. 3 depicts the slider member 240 at a substantially linear portion, e.g. 148, of the path defined by the slot 144. When the slider member 240 is on this portion of the path, note in FIG. 4 that the nozzle member diverter section 246 diverts the water flow therethrough slightly downwardly to thus discharge the stream with a component extending substantially parallel to the path defined by guide slot 144. Typically, the nozzle member 242 diverts the water flow by approximately 15 degrees from its primary direction along tube 238, i.e. essentially perpendicular to the plane of the path defined by the guide slot 144. This component parallel to the path produces a thrust or reaction force on the slide member 240 which causes it to translate along the guide slot 144. Nevertheless, the primary portion of the water-air stream exiting from the nozzle member 242 is directed substantially perpendicular to the guide path for impacting against the user's body. It should be noted that the slide member 240 is shaped and dimensioned to fit relatively closely within the guide slot 144 so as to effectively be keyed thereto. As a consequence, the guide slot 144 not only restricts the movement of the slide member 240 to a particular path but also reorients the slide member as it travels along the path to direct the thrust component of the discharged stream in a direction along the path to produce maximum thrust for translation.

Figures 5, 6:
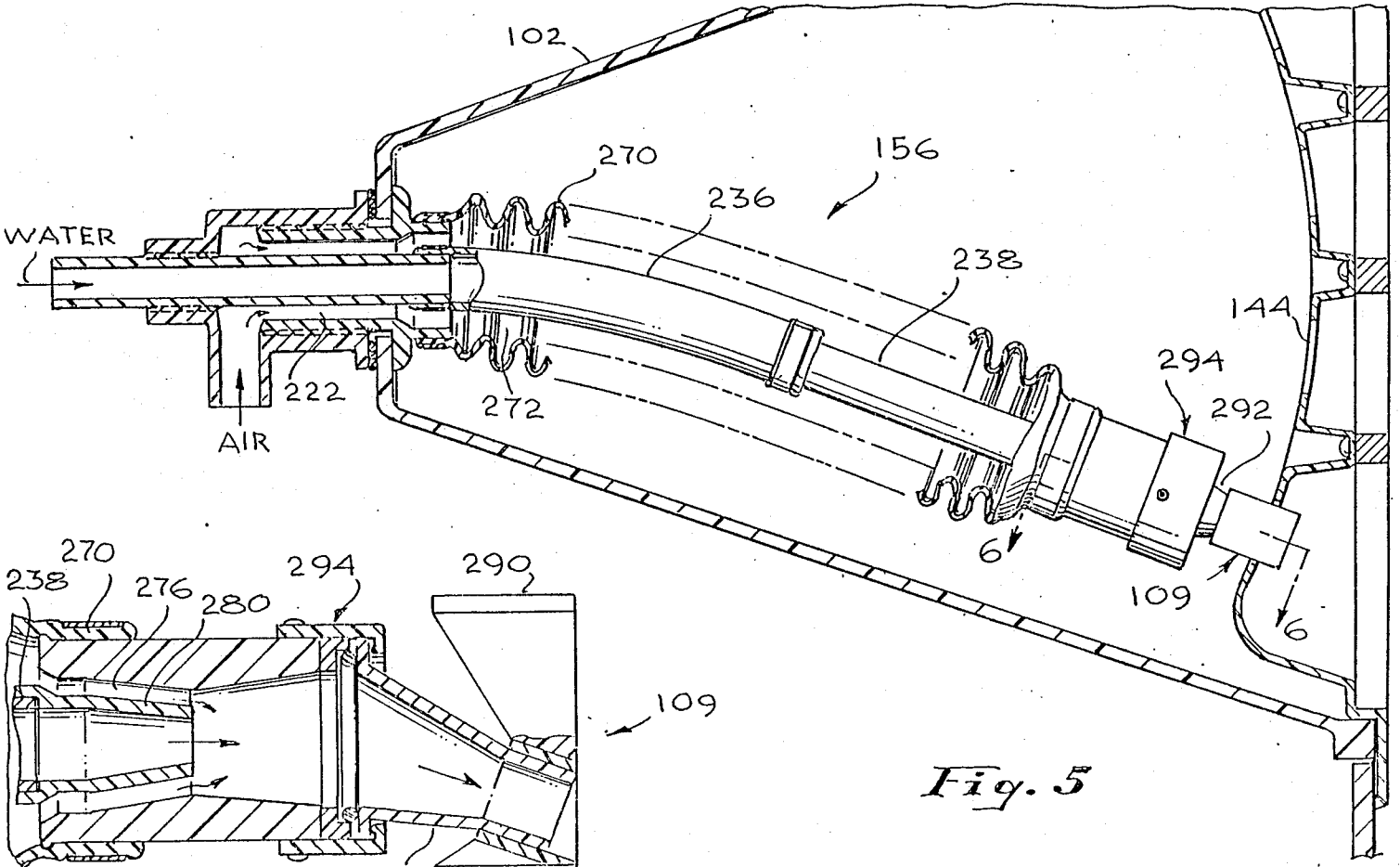
FIG. 5 is a sectional view similar to that depicted in FIG. 3 but illustrating an alternative embodiment of the invention.
FIG. 6 is a sectional view taken substantially along the plane 6—6 of FIG. 5.

Attention is now directed to FIGS. 5 and 6 which illustrate a second embodiment of the invention which is similar to that depicted in FIGS. 3 and 4 but which differs therefrom in that the water and air are mixed at the end of the conduit means 156 adjacent to the nozzle means 109, rather than proximate to the supply end of the conduit means as was illustrated in FIG. 3. More specifically, the conduit means of FIG. 5 is comprised of the aforementioned flexible tube 236 and rigid tube 238 of FIG. 3 but additionally includes, a flexible outer tube 270 which is mounted around and substantially concentric with the tubes 236 and 238. The flexible tube 270 defines an internal toroidal air passage 272 for coupling the aforementioned air passage 222 to air passage 276 extending around a tapered section 280 coupled to the rigid tube 238. That is, whereas, the venturi effect to entrain the air in the water stream in the embodiment of FIG. 3 was produced at the supply end of the conduit means 156 by narrowing down the end 211 of the tube 210, in the embodiment of FIG. 5 the venturi effect to entrain the air in the water stream is produced at the nozzle end of the conduit means 156 by tapering down the end of rigid tube 238 by section 280. In either case, the nozzle means 109, comprised of slide member 290 and nozzle member 292 in FIG. 6, is mounted for rotation relative to the rigid tube 238 by a rotational coupler 294. As was discussed in connection with the embodiment of FIGS. 3 and 4, as the slide member 290 translates along the path defined by the guide slot 144, the slide member automatically orients itself to rotate the nozzle member 292 relative to the rigid tube 238 to discharge the thrust component along the travel path to develop the maximum thrust for the amount of water flow.

Figures 7, 8, 9:
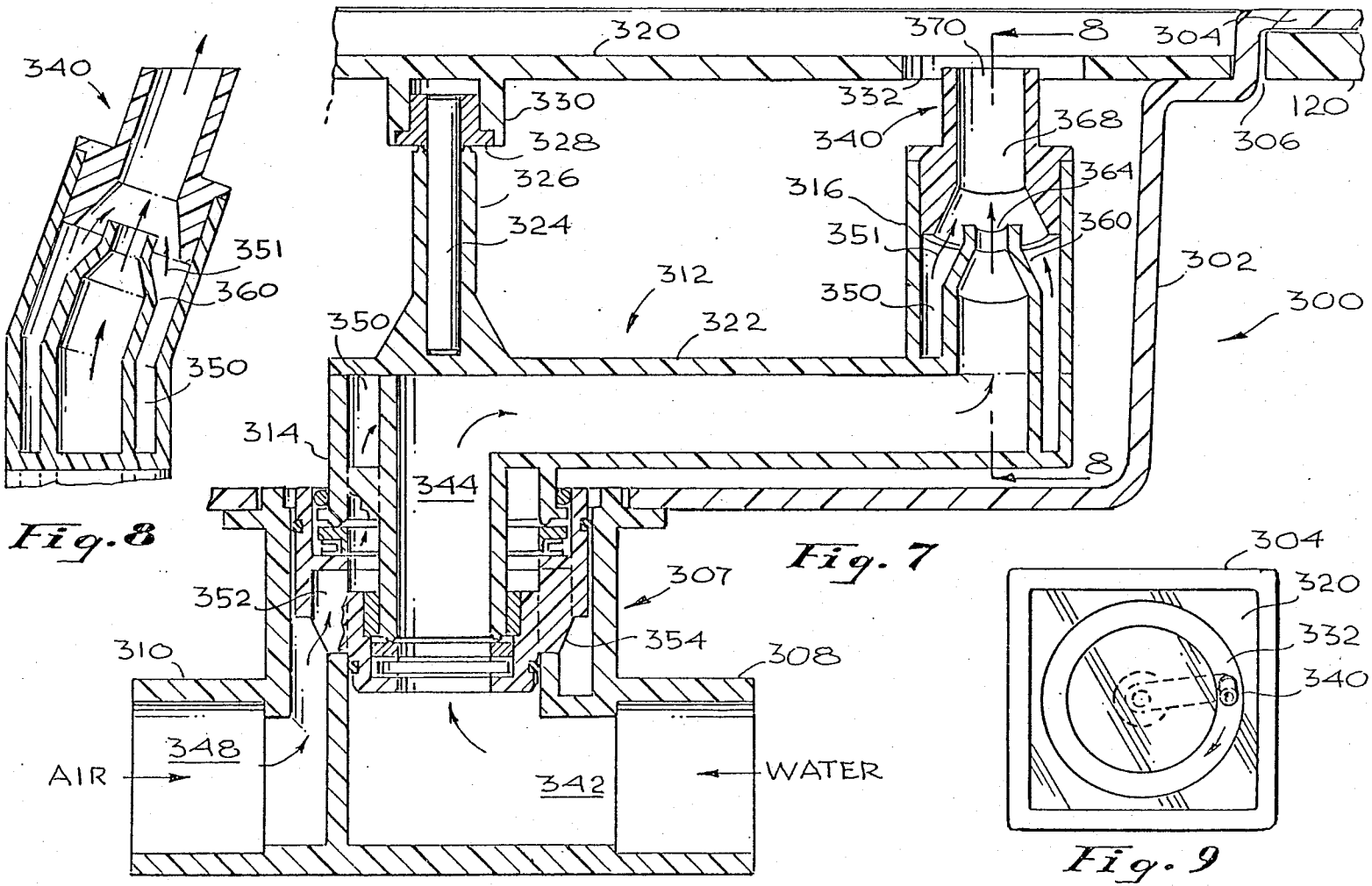
FIG. 7 is a sectional view of a further alternative embodiment of the invention.
FIG. 8 is a sectional view taken substantially along the plane 8—8 of FIG. 7.
FIG. 9 is a front view depicting the nozzle travel path of the embodiment of FIG. 7.
Figure 11:
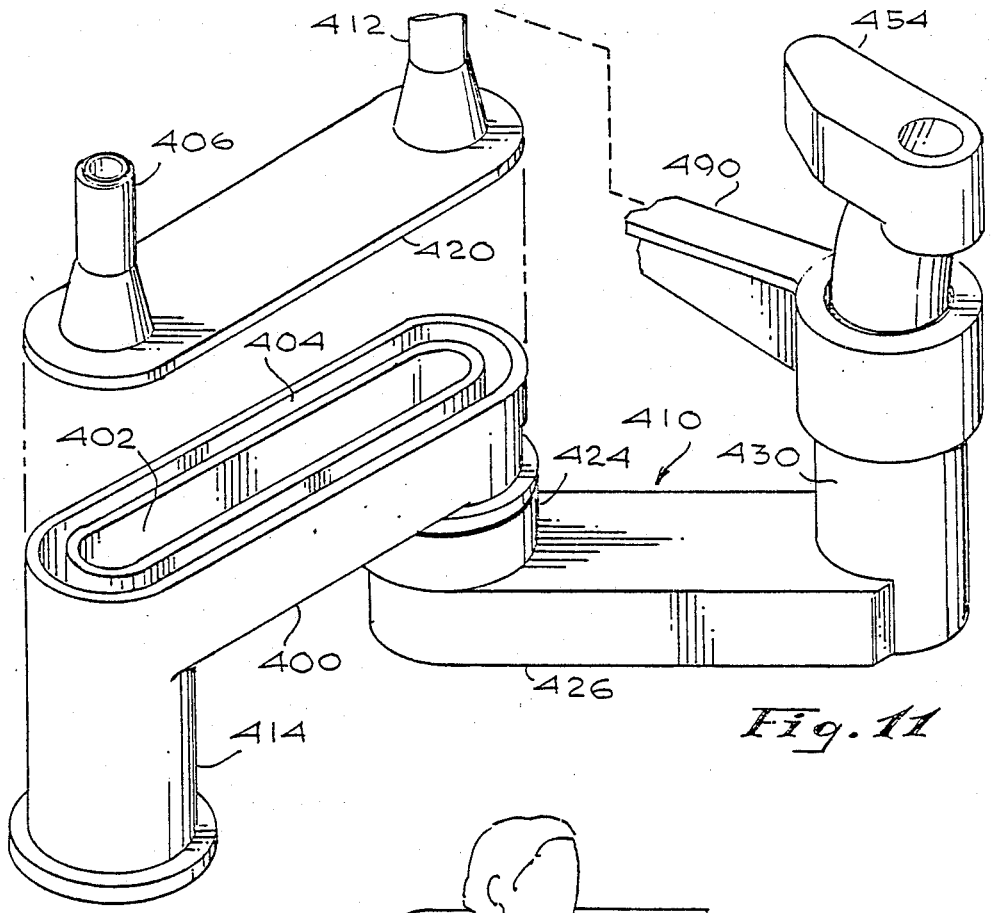
FIG. 11 is an isometric view of a still further alternative embodiment of the invention.
Figure 10:
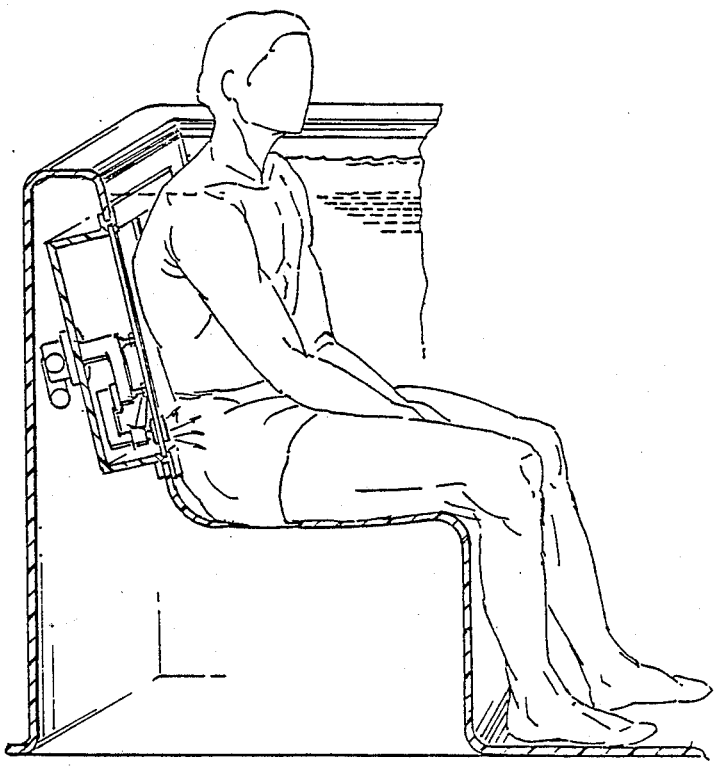
FIG. 10 is an isometric view similar to that of FIG. 2 but showing a shallower embodiment of the invention, as depicted in FIG. 11 mounted behind the perimeter wall of a spa.

Although the embodiments thus far discussed in FIGS. 3 and 5 both work well to permit a water stream to impact against and sweep across a relatively large area of a user's body, they require a relatively large depth behind the water tub perimeter wall to achieve the desired horizontal and vertical displacement of the nozzle means. A more compact arrangement is depicted in the embodiments of FIGS. 7 and 11. FIG. 10 generally depicts the embodiment of FIG. 11 mounted behind the flat wall portion 132 of a water tub 120. The embodiments of FIG. 7 and 11 achieve their compact depth in similar manners by utilizing arms mounted for rotation about axes extending substantially perpendicular to the tub wall. The embodiment of FIG. 7 is simpler in construction, and more limited in operation in that it is restricted to moving the nozzle means in a circular path, and will be discussed first.

The embodiment 300 of FIG. 7 includes a housing 302 including a front frame member 304. The housing is intended to be inserted through an opening 306 formed in the wall of water tub 120 with the frame member 304 bearing against the front face of the water tub wall. The embodiment 300 includes a fitting 307 having water inlet 308 intended to be connected to a water supply pipe and an air inlet 310 intended to be connected to an air supply pipe. Basically, the embodiment of 300 includes an essentially Z shaped arm structure 312 defining water and air passages extending therethrough. More specifically, the Z shaped arm structure 312 includes first and second leg portions 314 and 316 which extend parallel to each other and perpendicular to a front plate 320. The legs 314 and 316 are interconnected by an arm portion 322. The arm portion 322 is mounted for rotation about a pin 324 which is press fit into sleeve 326 formed integral with arm 322. The pin 324 extends beyond the end of sleeve 326 into thrust bearing 328 which is retained within nipple 330 extending rearwardly from the plate 320.

The plate 320 has an open slot 332 therein defining the circular path depicted in FIG. 9. A nozzle means 340 carried at the free forward end of the arm portion 316 extend into and is mounted for movement along the circular path defined by the slot 332.

The water inlet 308 defines an internal water passageway 342 communicating with an internal passageway 344 extending through leg portions 314, 316, and 322 of the Z shaped arm structure 312. The air inlet 310 defines an internal passageway 348 which communicates with an air passageway 350 via openings 352 formed between the fingers of a web member 354. The air passageway 350 extends around, and is isolated from, the central water passage way 344, through the length of the arm portion 322, to the leg portion 316. The water passageway 344, in leg portion 316, exits through a narrowed neck member 360 to develop a venturi effect to draw air from the air passageway 350 as depicted by air flow arrows 351. The water flow from passage 344 exiting through the orifice 364 of the neck 360 entrains the air 351 drawn through the air passage 350. The water-air mixture formed in the cavity 368 immediately downstream from the orifice 364 is then discharged through the discharge orifice 370 of the nozzle means 340.

It can be noted in FIG. 8 that the neck member 360 diverts the water flow from a path extending substantially perpendicular to the front plate 320 in a direction having a component extending parallel to the plate. This component produces a thrust force tending to move the nozzle means 340. Inasmuch as the nozzle means 340 is restricted from movement other than rotationally around pin 324, it will move along the slot 332 as depicted in FIG. 9. In so doing, the Z shaped arm 312 will rotate around an axis defined by leg portion 314. The leg portion 314 is mounted within the body of the fitting 307 in a manner which permits rotation while also providing a watertight and airtight seal.

Figures 12, 13:
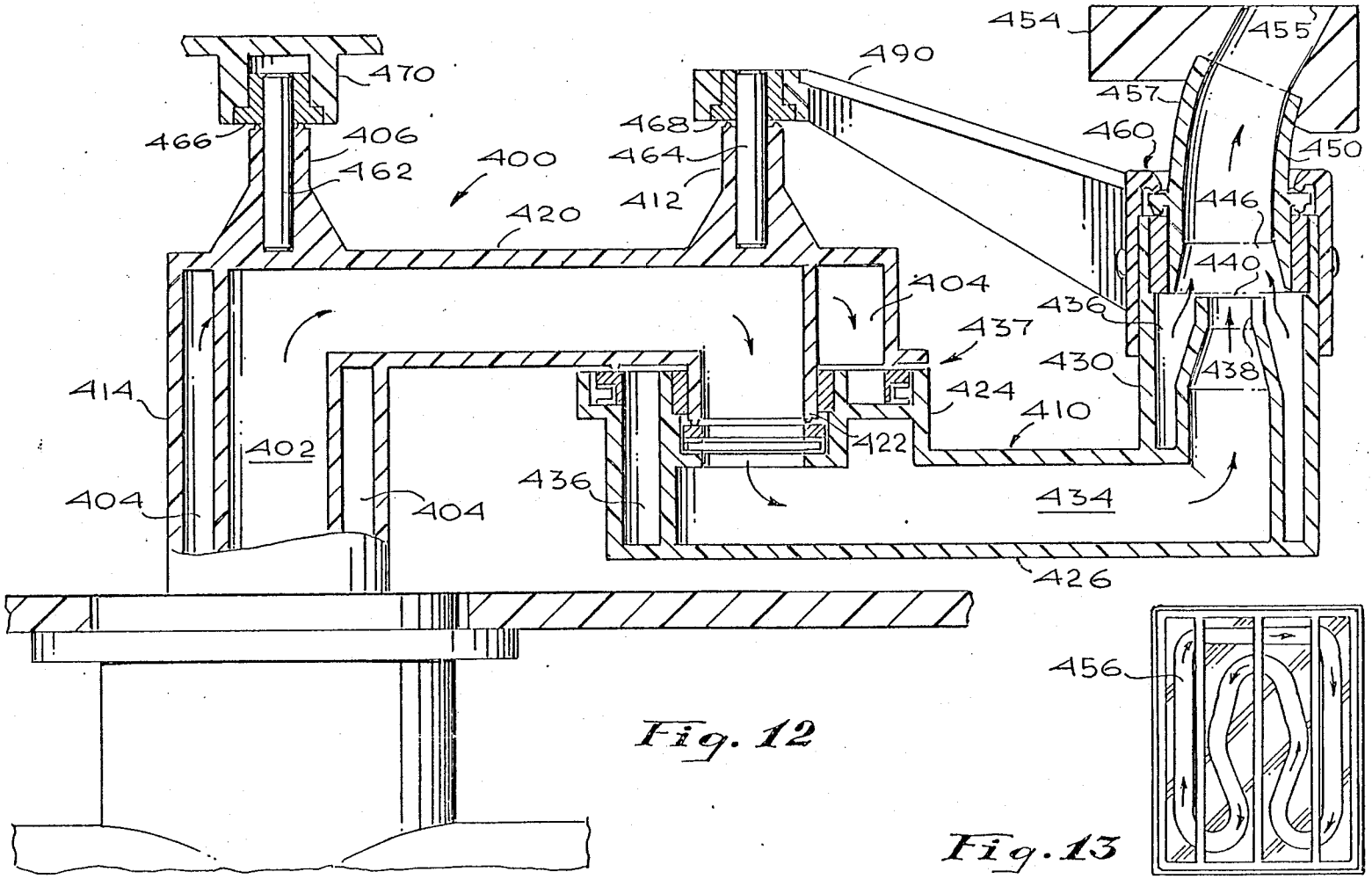
FIG. 12 is a sectional view of the embodiment depicted in FIG. 11.
FIG. 13 is a front view of an apparatus incorporating the embodiment of FIG. 12, illustrating the travel path of the moveable nozzle.

Whereas the embodiment depicted in FIGS. 7, 8 and 9 is restricted to nozzle movement along a circular path, the embodiment depicted in FIGS. 11, 12, and 13, which is similarly constructed, is able to translate its nozzle means along a complex path, as exemplified by the path depicted in FIG. 13. The construction and operation of the embodiment of FIGS. 11–13 can be best visualized in FIG. 11 which depicts a first arm member 400, defining internal water and air passages 402 and 404 respectively, mounted for rotation about a first axis defined by sleeve 406. The first arm 400 is connected to a second arm 410 which is mounted for rotation about a second axis defined by sleeve 412. As will be seen, sleeve 412 is mounted for rotation around the first axis defined by sleeve 406.

More particularly, the first arm 400 is comprised of a first depending leg portion 414 which defines the separate internal water and air passageways 402 and 404 respectively. These passageways are intended to be respectively connected to the water and air supply pipes mounted behind the water tub wall. The internal water and air passages 402 and 404 extend from the depending leg 414 through the connected arm portion 420 terminating in a depending nipple 422. An upwardly extending nipple portion 424 of arm 410 mates with the nipple portion 422, for rotation with respect thereto. The nipple portion 422 of arm 410 is coupled to a central arm portion 426 which in turn extends to a terminal leg portion 430. The arm 410 is constructed internally similar to arm 400 in that it defines water and air passages 434 and 436 respectively. Water passage 434 of arm 410 communicates with water passage 402 of arm 400 via rotary coupling 437. Similarly, air passages 404 and 436 are also coupled via rotary coupling 437.

The terminal leg portion 430 includes a narrowed neck member 438 defining an orifice 440. The orifice 440 communicates with the water passage 434 and discharges into a cavity 446 which draws air from the air passage 436 and entrains it in the water flow. The cavity 446 is defined in a nozzle member 450 which is coupled to a slider member 454 having a discharge orifice 455. The slider member 454 is mounted within a guide slot 456 for translation along a complex path as depicted in FIG. 13. Whereas the water-air stream discharged from orifice 455 is directed primarily perpendicular to the path defined by guide slot 456, nevertheless the nozzle member 450 includes a section 457 to divert the water stream flow to introduce a component which extends substantially parallel to the plane of the path defined by guide slot 456. This component parallel to the path produces a thrust on the slider 454 to move it along the path.

The slider member 454 and nozzle member 450 are fixed to one another and mounted for rotation about the axis of leg 430. The slider member 454 is keyed to the slot 456 to enable the slot to continually reorient the slider member as it moves along the travel path to direct the thrust component along the path to produce maximum thrust. The slider member 454 is able to traverse the complex path defined by slot 456 as a consequence of the rotational freedom around three spaced axes; i.e. the rotational freedom of the nozzle member 450 with respect to the leg portion 430 via rotary coupling 460, the rotational freedom of the arm 410 around the axis defined by the sleeve 412, and the rotational freedom of the arm 400 around the axis defined by the sleeve 406. Sleeves 406 and 412 respectively accommodate pins 462 and 464 which fit into bearings 466 and 468. The bearing 466 is fixedly mounted within nipple 470 fixed relative to the front guide plate. The bearing 468 is fitted into the end of a support strut 490 which is secured to the leg 430.

Figures 14, 15, 16, 17:
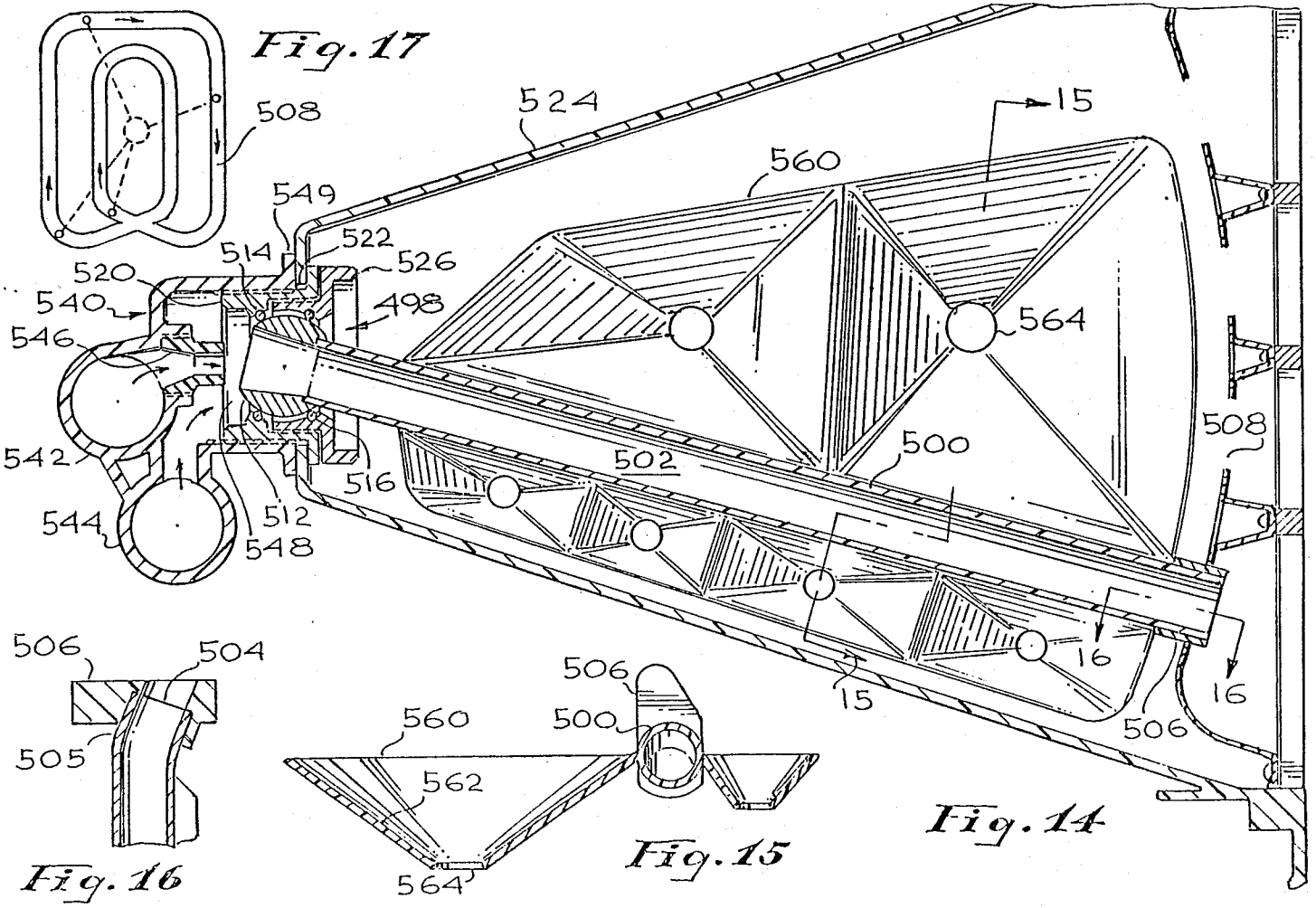
FIG. 14 is a sectional view of a still further alternative embodiment of the invention.
FIG. 15 is a sectional view taken substantially along the plane 15—15 of FIG. 14.
FIG. 16 is a sectional view taken substantially along the plane 16—16 of FIG. 13.
FIG. 17 is a schematic illustration depicting the travel path of the nozzle mains of the embodiment of FIG. 14.

Attention is now directed to a further alternative embodiment of the invention depicted in FIGS. 14–17. The embodiment of FIGS. 14–17 is similar to the embodiment of FIG. 3 except that in lieu of using the flexible tube 236 and rotary coupling 256 to afford the nozzle means 109 freedom of movement, the embodiment of FIGS. 14–17 uses a swivel ball and socket joint 498 at the supply end of a rigid tube connecting water and air supply sources to the nozzle means. More specifically,.FIG. 14 depicts a rigid tube 500 defining a central passageway 502. As shown in FIG. 16, the tube 500 is open at its free end 504 to define a nozzle. The nozzle end 504 is preferably bent at 505 and secured to a slide member 506. The slide member 506 is mounted for translation along guide slot 508. The bent end 504 diverts the stream flowing through passage 502 to produce a thrust component directed substantially parallel to the plane of guide slot 508.

The supply end of the rigid tube 500 has a spherical surface 512 formed thereon which is mounted between and adapted to rotate with respect to a socket formed by a pair of sealing teflon O-rings 514 and 516. The O-ring 514 is intended to be seated in a notch formed in the internal bore of an internally and externally threaded fitting 520 which extends through an opening 522 formed in the rear wall of housing 524. The O-ring 516 is fitted within an internal notch in the central bore of an externally threaded fitting 526 intended to be threaded within the central bore of the fitting 520. The external threads on the fitting 520 in turn are intended to be threaded into an internal bore of a water-air jet subassembly 540. The subassembly 540 includes a water inlet tube 542 intended to be connected to a water supply pipe and an air inlet tube 544 intended to be connected to an air supply pipe. The water inlet 542 is coupled to a short tube 546 having a necked down passage to, by venturi action, produce a low pressure for drawing air into cavity 548 from the air inlet 544. The water-air mixture produced in cavity 548 is then forced into the supply end of the passage 502 formed in rigid tube 500.

Note that the water-air jet subassembly 540, fitting 520, and fitting 526 can be readily assembled and secured to the housing 524. The subassembly 540 includes a flange 549 intended to bear against the rear face of the housing 524. The fitting 520 includes a flange intended to bear against the front internal face of the rear portion of the housing when the fitting 520 is threaded into the subassembly 540. The fitting 520 retains the aforementioned rear O-ring 514. The ball portion 512 of the rigid tube 500 is placed against the O-ring 514 and then the fitting 526 is threaded into the fitting 520 to draw the O-ring 516 down against the ball portion 512 of the tube 500. The O-rings need not be drawn snugly against the ball to prevent leakage therepast inasmuch as the discharge thrust from the tube 546 typically seats the ball against O-ring 516. By a selection of the correct materials, the ball portion 512 is able to easily rotate within the socket defined by the spaced O-rings 514 and 516.

In accordance with a feature of the embodiment of FIGS. 14–17, the complex path defined by the guide slot 508 is configured, as depicted in FIG. 17, to enable the nozzle means to continually move in a clockwise direction as shown by the arrows in FIG. 17. The continual translation of the slider member 506 in a clockwise direction along the slot 508 will act to tighten the fitting 526 in fitting 520, and the fitting 520 in the subassembly 540, thus enhancing the reliability and maintenance free operation of this embodiment.

As has previously been noted, the speed with which the slider member 506 translates along the slot 508 depends upon several factors including the pressure and magnitude of the stream discharge and the angle with which the stream is diverted by the section 504. The force with which the discharged stream impacts against the user's body for massaging is similarly dependent upon these factors. As is depicted in FIG. 30, it is desirable to provide the user with a manual valve 170 to enable him to control the impact force against his body.

The pump 162, for example, can typically provide an output pressure of 30 PSI and the user may desire to cut this down substantially for comfort. In order to enable the user to vary the impact force without significantly changing the speed with which the nozzle slider 506 translates along its travel path, it is desirable to select the stream discharge angle to yield sufficient nozzle movement speed at a relatively low pressure, e.g. 10–15 PSI. Additionally, it is necessary to select the discharge angle so it is sufficient to provide an adequate starting thrust regardless of the position of the nozzle means when the system is initially turned on. It should of course be appreciated that the magnitude of thrust required to assure that the nozzle means comes up to speed from rest is greater than that required to maintain the speed of the nozzle means once it is already in motion. In order to accommodate a discharge angle sufficient to ensure start up and yet prevent the nozzle means, from thereafter moving at an uncomfortably high speed, a speed sensitive drag means is incorporated in the embodiment of FIGS. 14–17.

More specifically, the speed sensitive drag means comprise one or more cupped plates 560 mounted on and extending substantially radially from the rigid tube 500. The plate 560 is internally cupped to define a cone-like internal surface 562 having an aperture 564 at its apex. The cupped plate 560 acts similarly to a sea anchor in that it exhibits very low drag at low speed ad increasing drag as the tube 500 attempts to move more quickly through the water. Preferably, the cupped plates 560 extend radially outward in both directions from the tube 500 (FIG. 15). Note that in the embodiment of FIGS. 14–17, the slider member 506 and the cupped plates 560 are fixed in position relative to the tube 500 which in turn is able to rotate with respect to the jet subassembly 540 via the swivel joint 498. Inasmuch as the slider member 506 is essentially keyed in the slot 508, the orientation of the cupped plates 560 is always determined by the orientation of the slider member 506 which is at all times dependent upon its position along the guide path. As a consequence of these interrelationships, the cupped plates 560 will always extend substantially normal to the instantaneous direction of movement of the tube 500 to thus continually act to limit the nozzle means speed along the path.

Whereas the embodiment of FIGS. 14–17 is rather simple in construction and can be manufactured relatively inexpensively of plastic, e.g. ABS, parts, it requires a relatively deep housing 524 to accommodate the amount of horizontal and vertical nozzle travel which may be desired. Thus, a similar embodiment depicted in FIGS. 18–24 can be used where a shallower housing depth is desirable. Briefly, in lieu of using a straight rigid tube 500 having a fixed nozzle connected thereto as depicted in FIG. 14, the embodiment of FIGS. 18–24 utilizes a curved rigid tube 600 which has a nozzle means 602 rotationally coupled thereto via rotary coupling 603. The tube 600 is specially configured to minimize pressure drops in the water-air stream which might occur upon entry of the stream into the tube and as it flows along the tube from its supply end to its nozzle end. More particularly, the tube 600 can be viewed as including a first straight section 606 coupled to and extending outwardly along the axis of the tapered central bore 608 of ball 610. Ball 610 is seated for rotation within a socket defined in fitting 612, to be further discussed hereinafter.

Figure 24:
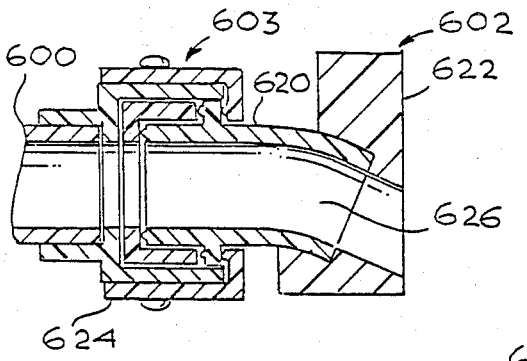
FIG. 24 is a sectional view taken substantially along the plane 24—24 of FIG. 23.

From straight tube section 606, the tube 600 gently curves through section 614. A substantially straight section 616 couples curved section 614 to a gently curved section 618 connected to the rotary coupling 603. The nozzle means 602 includes a nozzle member 620 mounted for rotation in the rotary coupling 603 (FIG. 24). Additionally, the nozzle means 602 includes a slider member 622 which is fixedly mounted on the end of the nozzle member 620. Note that the nozzle member 620 defines an internal passage including a first section 624 having an axis substantially coincident with the axis of the tube section 618. The nozzle member 620 internal passage bends slightly at 626 (FIG. 24) to produce the aforediscussed thrust component for moving the nozzle means along the guide path.

Figure 18:
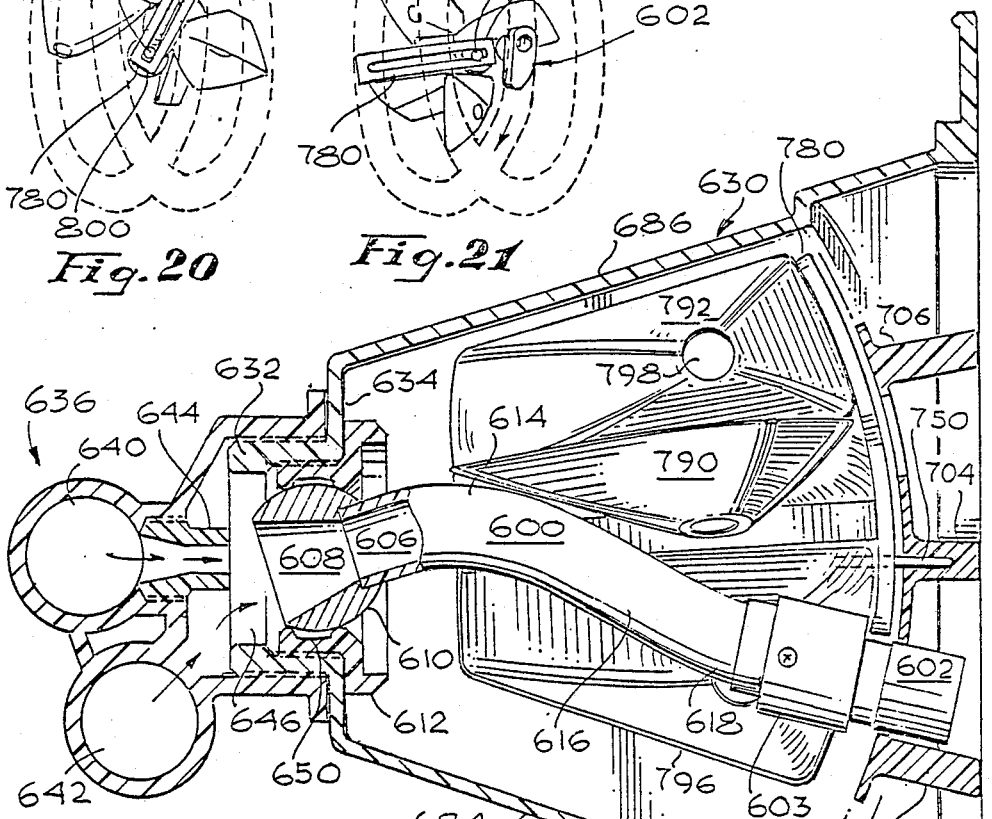
FIG. 18 is a top sectional view of a still further alternative embodiment of the invention.

The embodiment of FIGS. 18–24 includes a housing 630 which is depicted as including an integral internally and externally threaded pipe section 632 extending rearwardly from the housing rear wall 634. A water-air jet subassembly 636 is externally threaded (or otherwise equivalently fastened, as by an adhesive) to the housing pipe section 632. The subassembly 636 includes a water inlet 640 and an air inlet 642. Water entering the inlet 640 is discharged through a short nozzle member 644 into a cavity 646. The discharged water stream is then mixed with air entering from the air inlet 642. As previously mentioned, the air can be drawn in through the inlet 642 via venturi action caused by the water exiting from the nozzle 644, or alternatively, air can be supplied to the inlet 642 as from a blower (175 in FIG. 30). The fitting 612 has external threads and is threaded into the inner bore of the housing pipe section 632 as is best shown in FIG. 18. The fitting 612 defines an internal socket-like surface 650 against which the ball 610 can rotate. The water-air stream discharged into the bore 608 of the ball essentially seats the ball against the surface 650 preventing leakage therepast. However, by proper choice of materials, the ball 610 can freely rotate with respect to the surface 650.

Figure 26:
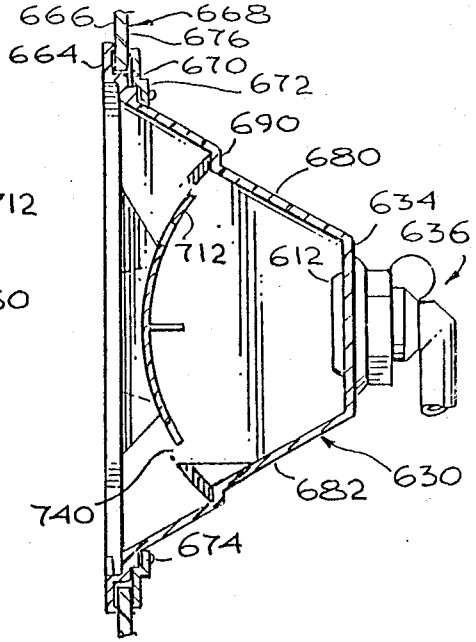
FIG. 26 is a sectional view taken substantially along the plane 26—26 of FIG. 25.
Figure 25:
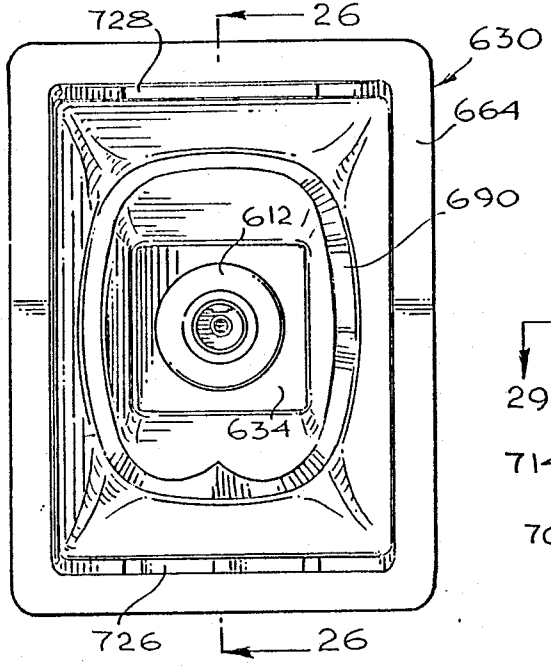
FIG. 25 is a front view of the housing of the embodiment of FIG. 23.

Before proceeding further with an explanation of the structure of the tube 600 and the unique manner in which it is mounted for movement, attention is directed to FIGS. 25–29 which illustrate a preferred structural arrangement of the housing 630 utilized in FIGS. 18–24 and the front grill structure 660 adapted to be mounted to the housing to define the guide path for the nozzle means 602. FIG. 25 depicts a front view of the housing 630 showing its front rectangular frame 664 adapted to bear against the front face 666 of a perimeter wall 668 of a water tub (FIG. 26). The housing 630 projects through an opening 670 in the wall 664. A clamping ring 672 is intended to be secured to the housing as by screws 674 for bearing against the rear face 676 of the perimeter wall 668. Thus the clamping ring 672 can tightly sandwich the perimeter wall 668 between itself and the housing frame 664, with suitable sealing material provided therebetween for preventing water leakage.

Figure 23:
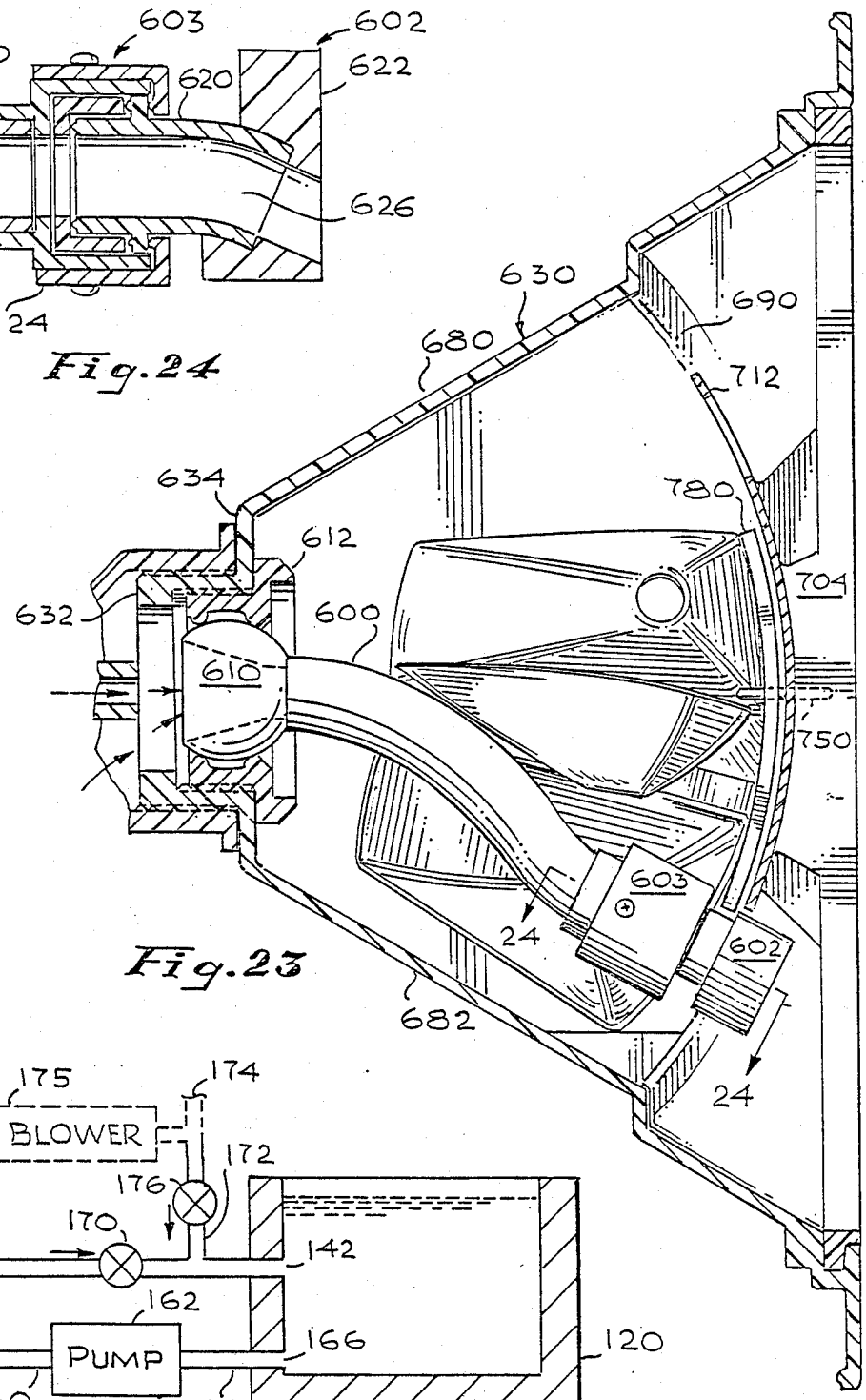
FIG. 23 is a side sectional view of the embodiment of FIG. 18.
Figure 28:
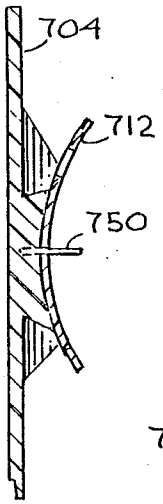
FIG. 28 is a sectional view taken substantially along the plane 28—28 of FIG. 27.
Figure 27:
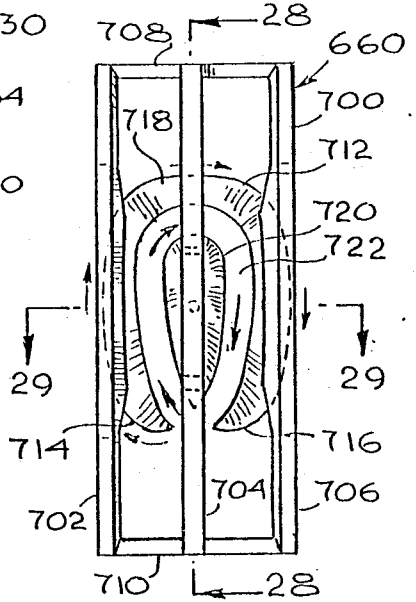
FIG. 27 is a front view of the removable grill used in conjunction with the housing of FIG. 27.
Figure 29:
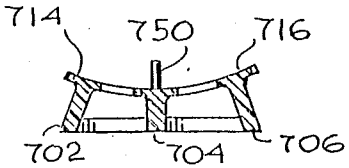
FIG. 29 is a sectional view taken substantially along the plane 29—29 of FIG. 27.

As depicted in FIGS. 25 and 26, the frame 664 surrounds an opening into a housing cavity extending rearwardly to the housing rear wall 634. As depicted in FIGS. 18, 23 and 26, the housing is essentially trapezoidal in cross section having upper and lower walls 680 and 682 extending from the rear housing wall 634 to the front open frame 664. Left and right housing side walls (looking rearwardly toward rear wall 634) are depicted at 684 and 686 in the top view shown in FIG. 18 It will be noted that each of the housing walls 680, 682, 684, and 686 includes a shoulder 690 which extends peripherally within the housing. The shoulder 690, together with the grill structure 660, define the guide path for the movement of the nozzle means 602. More specifically, the grill structure 660 is comprised of a frame 700 including vertical bars 702, 704 and 706. The bars are secured to upper and lower cross members 708 and 710. A horseshoe member 712 is mounted on the bars and is curved, as is best depicted in FIGS. 28 and 29 so as to appear substantially concave looking forwardly through the housing cavity from the rear wall 634. The horseshoe member 712 essentially includes depending leg portions 714 and 716 interconnected by a cross member 718. A central member 720 is supported on the bar 704 within the horseshoe shaped area defined by member 712. The central member 720 is spaced from the horseshoe member 712 to define a guide slot 722 therebetween.

The cross members 708 and 710 of the front grill 660 are intended to be snapped into recesses 726 and 728 in the housing front frame 664. When the grill 660 is so placed (FIG. 26) the horseshoe member 712 will extend rearwardly with the edges thereof being spaced from the housing internal shoulder 690 to thus define guide slot portion 740. It is also pointed out that the grill 660 includes a pin 750 which extends rearwardly from the bar 704 positioned substantially centrally of the horseshoe shaped area defined within member 712 and substantially coincident with the axis of nozzle 644. The housing and grill structures depicted in FIGS. 25–29 cooperate to define a guide slot shaped as is shown in FIGS. 20, 21, and 22.

Returning now to the curved rigid tube 600, it is pointed out that the curved portions 606 and 618 thereof are gently curved to facilitate smooth flow therethrough for all permissible orientations of the tube relative to the water-air stream entering through bore 608 of ball 610. That is, it is desirable that the tube 600 be constructed so as to minimize the pressure drops which might occur in the stream upon entry into, and flow along, the tube 600. To facilitate smooth flow of the stream through the tube 600, the curved sections 606 and 618 preferably lie in substantially the same plane and the planar orientation of the tube 600 is at all times maintained substantially radial to the axis of the nozzle 644. That is, as the nozzle means 602 translates along the guide path defined by the housing and grill structures, the plane of tube 600 is adjusted to maintain it substantially radial to the axis of nozzle 644 with the straight tube section 606 thus deviating by not more than about sixteen degrees from the axis of nozzle 644.

Figure 19:
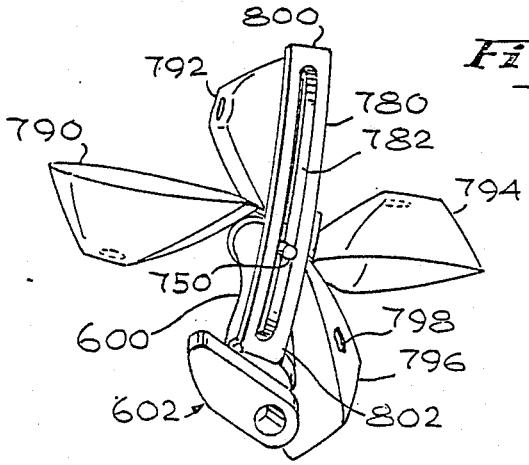
FIG. 19 is an isometric illustration generally depicting the nozzle, conduit and drag means of the embodiment of FIG. 18.

In order to maintain this radial orientation of the plane of tube 600, an arm 780 having a slot 782 therein is mounted for movement on the aforementioned pin 750 projecting rearwardly from bar 704. Because of the relationship of the arm slot 782 and the pin 750, the arm 780 will always extend in a substantially radial direction from the pin 750. In order to assure that the plane of the tube 600 also extends substantially radial to the pin 750 (and thus radial to the coincident axis of nozzle 644), the arm 780 and tube 600 are structurally fixed to one another. This is accomplished, as is best shown in FIG. 19, which depicts drag means in the form of cupped plates 790, 792, 794, and 796 secured to the tube 600 in a substantially cruciform fashion. Each of the cupped plates includes an aperture 798 therein so that the cupped plates essentially act as sea anchors to slow the movement of the tube 600, and thus the nozzle means 602, through the water. The slotted arm 780 is secured to the forward edge of cupped plate 792 which in turn is secured to the tube 600. Thus, the plane of tube 600 will be fixed with respect to the elongation of arm 780 which in turn will be maintained in orientations radial to fixed pin 750.

Figure 20:
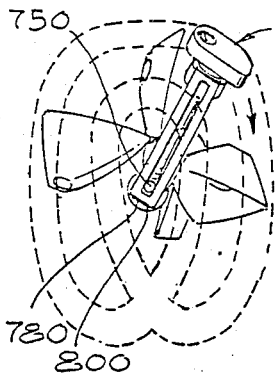
FIGS. 20, 21, 22 are front schematic illustrations respectively depicting the orientations of the nozzle and related elements for different positions of the nozzle along the travel path.
Figure 21:
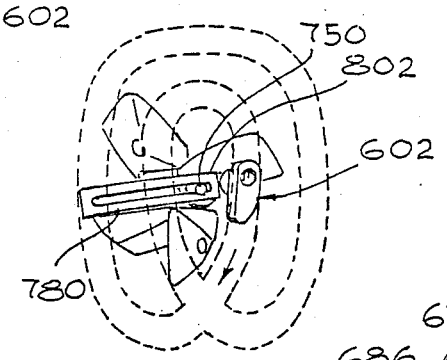
Figure 22:
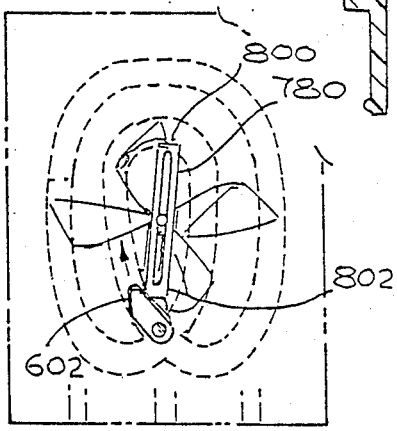

FIGS. 20, 21, and 22 schematically depict the movement of the slotted arm 780 with respect to the pin 750 for various positions of the nozzle means 602 along the guide path. Note for example in FIG. 20 when the nozzle means 602 is at the one o'clock position in the outer loop of the guide path, the arm 780 moves to a position where the pin 750 is very close to the free end 800 of the arm. Note in FIG. 21 when the nozzle means 602 is essentially at the three o'clock position on the inner loop of the guide path, the arm 780 moves to a position where the pin 750 is at the inner end 802 of the arm 780. FIG. 22 depicts the nozzle means moving from the outer loop of the guide path to the inner loop, at substantially a six o'clock position, and shows the pin 75Q substantially intermediate the ends 800 and 802 of the arm 780.

It should be noted in FIGS. 20, 21, and 22 that the nozzle means 602 continually moves in a clockwise direction, as depicted by the arrows along the guide slot. With this motion, the ball 610 tends to continually turn clockwise within the fitting 612. Thus, any friction between the surface of the ball 610 and the socket surface 650 of the fitting 612 will tend to tighten the threaded coupling between the fitting 612 and the rearwardly extending pipe section 632 of housing 630. It should also be noted that the cupped plates 790, 792, 794 and 796 have been shown slightly exaggerated for clarity. In actuality, of course, it is essential that they be dimensioned so as to be accommodated within the housing 630 without contacting the housing wall for all positions of the nozzle means 602 along the guide path.

From the foregoing, it should now be apparent that an improved method and apparatus for hydrotherapy has been disclosed herein. In preferred embodiments, the method and apparatus is characterized by discharging a stream of water into a tub through an opening in the tub wall and translating the water stream along the path extending substantially parallel to the tub wall there at. Although particular embodiments of the invention have been described and illustrated in detail, it is recognized that various modifications and alternatives may readily occur to those skilled in the art and it is intended that the claims be interpreted to cover such modifications, alternatives, and other equivalents.

We claim:

1. A method of massaging a user's body in a water tub having a perimeter wall, said method comprising the steps of:

discharging a pressurized stream of water onto a user's body through a discharge orifice into said tub through an opening in an area of said wall; and repetitively translating said orifice, while discharging said stream, entirely around a closed noncircular path defining a two dimensional area oriented substantially parallel to said wall area and extending in first and second substantially perpendicular directions so as to massage different portions of a user's body.

2. A method of massaging a user's body in a water tub having a perimeter wall, said method comprising the steps of:

supplying a pressurized water flow;

supplying air for mixing with said water flow to produce a water-air stream;

discharging said water-air stream onto a user's body through a discharge orifice into said tub through an opening in an area of said wall; and orienting said discharge orifice such that said stream is discharge in a direction having a massage component extending substantially perpendicular to said wall area and a thrust component extending substantially parallel to said wall area and causing said discharge orifice to move entirely around a closed path defining a two dimensional area oriented substantially parallel to said wall area so as to massage different portions of a user's body.

3. A method of massaging a user's body in a water tub having a perimeter wall, said method comprising the steps of:

supplying a water stream;

discharging said water stream onto a user's body through a discharge orifice into said tub through an opening in an area of said wall;

orienting said discharge orifice such that said stream is discharged in a direction having a primary component extending substantially perpendicular to said wall area for impacting against said user's body and a secondary component extending substantially parallel to said wall area for producing a thrust on said discharge orifice in a direction substantially parallel to said wall area;

guiding said discharge orifice entirely around a closed path defining a two dimensional area oriented substantially parallel to said wall area; and directing said secondary component in the direction of said path and moving said discharge orifice along said path so as to massage different portions of a user's body.

* * * * *